US008517234B2

(12) United States Patent
Kincaid et al.

(10) Patent No.: US 8,517,234 B2
(45) Date of Patent: Aug. 27, 2013

(54) ADJUSTABLE, DETACHABLE ACCESSORY ATTACHMENT SYSTEM

(75) Inventors: Robert A. Kincaid, Bozeman, MT (US); Eric M. Yeates, Virginia Beach, VA (US); Thomas M. Gregory, Belgrade, MT (US); Thomas A. Marx, Virginia Beach, VA (US)

(73) Assignee: Alliant Techsystems Inc., Minneapolis, MN (US)

( * ) Notice: Subject to any disclaimer, the term of this patent is extended or adjusted under 35 U.S.C. 154(b) by 231 days.

(21) Appl. No.: 12/736,522

(22) PCT Filed: Apr. 15, 2009

(86) PCT No.: PCT/US2009/002347

§ 371 (c)(1),
(2), (4) Date: Feb. 3, 2011

(87) PCT Pub. No.: WO2009/145850

PCT Pub. Date: Dec. 3, 2009

(65) Prior Publication Data

US 2011/0121043 A1 May 26, 2011

Related U.S. Application Data

(60) Provisional application No. 61/124,177, filed on Apr. 15, 2008.

(51) Int. Cl.
*F41C 33/02* (2006.01)

(52) U.S. Cl.
USPC ..... 224/198; 224/271; 224/272; 224/243; 224/665; 224/192; 224/912; 403/348; 403/322.4

(58) Field of Classification Search
USPC ..... 224/197, 198, 271, 272, 242, 243, 224/282, 553, 199, 200, 665, 192, 193, 238, 224/239, 911, 912, 443, 548; 403/344, 348, 403/322.4
See application file for complete search history.

(56) References Cited

U.S. PATENT DOCUMENTS

| | | | | | |
|---|---|---|---|---|---|
| 1,238,928 | A * | 9/1917 | Martz | 285/88 |
| 2,658,650 | A * | 11/1953 | Jasper | 224/200 |
| 3,134,316 | A * | 5/1964 | Rentschler | 396/293 |
| 4,669,907 | A * | 6/1987 | Patton | 403/78 |
| 5,626,435 | A * | 5/1997 | Wohlhuter | 403/348 |
| 2006/0196903 | A1 * | 9/2006 | Tanzini | 224/200 |

* cited by examiner

*Primary Examiner* — Nathan J Newhouse
*Assistant Examiner* — Scott McNurlen
(74) *Attorney, Agent, or Firm* — Wooten & Shaddock, PLC

(57) ABSTRACT

An accessory attachment system having a platform body with a platform recess, an accessory mounting plate having a plurality of mounting plate projections extending therefrom and a plurality of mounting plate apertures formed therethrough, wherein at least some of the mounting plate projections correspond to at least some of the slots so that when the mounting plate projections are aligned with the corresponding slots, the accessory mounting plate can pass the locking ledge into the platform recess, at least one release lever that is pivotable between a locking position and an unlocking position, and a plurality of internal stops formed within the platform recess, wherein the accessory mounting plate can be secured within a portion of the platform recess such that the mounting plate projections are secured between the internal stops and the accessory plate engagement portion when the release lever is in the locking position.

15 Claims, 11 Drawing Sheets

ADJUSTABLE, DETACHABLE ACCESSORY ATTACHMENT SYSTEM

CROSS-REFERENCE TO RELATED APPLICATIONS

This patent application claims the benefit of U.S. patent application Ser. No. 61/124,177, filed Apr. 15, 2008, the disclosure of which is incorporated herein by reference.

BACKGROUND OF THE INVENTION

1. Field of the Invention

The present invention is directed generally to an accessory attachment system. More specifically, the present invention is directed to an adjustable, detachable accessory attachment system that is adjustable in regard to the angle at which an attached accessory is carried and allows an accessory to be easily removed or replaced.

2. Description of Related Art

Certain adjustable cant or adjustable angle holsters and removable handgun holsters are known in the industry. These holsters are adjusted by matching, rearranging, or realigning separate bolt circle patterns on the holster and the attaching device that is used to mount the holster on the body. In this manner, vertical, forward, or rearward carrying angles can be achieved.

These angles allow the user to better position the exposed gripping surface of the handgun in regard to the numerous conditions encountered or imposed by the user/wearer.

Such situations can include the user's need to draw the handgun as well as protect the handgun while holstered. Specific positioning angles can also benefit the carrying of the handgun depending on the wearer's body type and mode of dress. In some cases, angle-adjustability can also compensate for the user's activities while carrying the handgun.

As such, greater adjustability than just matching or purposely mismatching (generally 3-hole) bolt circle patterns is often desired or even required.

One approach is to screw together two identical, circular, sunburst-patterned, grooved surfaces with a single screw or bolt through their separate centers. In theory, this allows for a 360° rotation where the points of adjustment are dependent only on the number of matching or mating grooves of each surface on each half of the assembly.

However, the strength of such an assembly is founded not only on the single screw or bolt (which is obviously subject to breaking or loosening) but also on the "as designed" contours of the nesting or mating surfaces and the actual "in use" condition of those contours (subject to manufacturing capabilities and wear in the field thru repeated adjustment). Breakage and slippage are not uncommon in such designs.

Removable holsters (i.e., designs whereby a holster can be readily removed from the wearer's body without having to unthread the holster from a belt), have long been seen in civilian and non-uniform police sectors. These holsters generally employ some sort of clip that fastens to the wearer's waistband or a "paddle" (a large piece of material—sometimes gently precurved to accommodate the wearer's hip structure) that is tucked down into the wearer's waistband holding the holster (and the carried handgun) in place thru pressure against the hip and/or friction created against the wearer's clothing.

SUMMARY OF THE INVENTION

However, while the tension created in such designs is generally adequate for certain limited applications, it is not sufficient for other applications, such as, for example, conventional uniformed police and military duty. Such holsters are not stable enough for the activities associated with certain roles nor are they secure enough from attack by offenders as they can allow unauthorized removal in the same manner that the user takes them off when unneeded.

Therefore, the present invention offers an accessory attachment system that can be readily adjusted for holster carrying angle and allows a holster or other accessory to be readily removed and replaced depending on the situation a user is in (such as entering secure areas where no handguns are allowed or, in some cases, trying to "fit" into vehicles where a protruding handgun could actually be a hindrance or even a danger to them). The accessory attachment system is also more resistant to attack from someone attempting to "steal" a handgun from a holster.

The adjustable, detachable accessory attachment system offers the user the opportunity to put on any holster (or other carrier, pouch, or other device) of their choosing in a plurality of carrying angles and then remove it at any time without having to unthread the assembly from a belt, unfasten it from an interwoven, web-based, carrying system like those found on military vests and armor carriers, or remove it as an assembly from the leg as in the case of commonly found police and military tactical holsters.

The prior holster holders and carriers fail to provide a user with the ability to readily and easily re-position a holster or other attached accessory carrier from a normal, carry position to a rotated or angular position. Furthermore, the prior holster holders fail to provide a holster holder or carrier that provides a user with the ability to readily and easily remove a holster or other attached accessory carrier.

Accordingly, the present invention is directed generally to an adjustable, detachable accessory attachment system that is adjustable in regard to the angle at which an attached accessory is carried and allows an accessory to be easily removed or replaced.

In various exemplary embodiments, the platform comprises a platform body and an accessory mounting plate.

In various exemplary embodiments, the accessory attachment system comprises a platform body having a platform recess; an accessory mounting plate having a plurality of mounting plate projections extending substantially radially therefrom and a plurality of mounting plate apertures formed therethrough; wherein the mounting plate projections correspond to the slots such that when the mounting plate projections are aligned with the corresponding slots, the accessory mounting plate can pass the locking ledge into the platform recess of the platform body; two release levers, pivotably positioned within release lever receiving slots formed in the platform body, wherein the release levers each comprise a thumb/finger engagement portion and an accessory plate engagement portion, and wherein the release levers are pivotable between a locking position and an unlocking position; and a plurality of internal stops formed within the platform recess for interacting with the mounting plate projections to limit rotation of the accessory mounting plate within the platform recess; wherein the accessory mounting plate can be secured within a portion of the platform recess such that the mounting plate projections are secured between the internal stops and the accessory plate engagement portion when the release lever is in the locking position.

In various exemplary embodiments, the accessory attachment system comprises a platform body having a platform recess, wherein the platform recess is defined by a bottom wall, a perimeter wall that extends substantially perpendicular to the bottom wall, and a locking ledge that extends inwardly from the perimeter wall substantially parallel to the bottom wall, and wherein the locking ledge includes a plurality of slots extending toward the perimeter wall; an accessory mounting plate having a plurality of mounting plate projections extending substantially radially therefrom and a plurality of mounting plate apertures formed therethrough; wherein at least some of the mounting plate projections correspond to at least some of the slots such that when the mounting plate projections are aligned with the corresponding slots, the accessory mounting plate can pass the locking ledge into the platform recess of the platform body; at least one release lever, pivotably positioned, via a pivot pin, within a release lever receiving slot formed in the platform body, wherein the at least one release lever comprises a thumb/finger engagement portion and an accessory plate engagement portion, and wherein the release lever is pivotable between a locking position and an unlocking position; and a plurality of internal stops formed within the platform recess for interacting with the mounting plate projections to limit rotation of the accessory mounting plate within the platform recess; wherein the accessory mounting plate can be secured within a portion of the platform recess such that the mounting plate projections are secured between the internal stops and the accessory plate engagement portion when the release lever is in the locking position.

Thus, in certain exemplary embodiments, a holster or other accessory carrier may be attached or coupled to the accessory mounting plate such that the accessory mounting plate can removably engage the platform body at a number of possible angles to allow a user to have a desired access to a holstered handgun or a carried accessory.

Thus, the present invention comprises a new and improved platform that allows an attached holster or other accessory carrier to be attached at one or more determined angles relative to the platform.

Accordingly, this invention provides a platform, having a simple and reliable holster or accessory carrier attachment system.

This invention separately provides a platform, which is capable of being manufactured using injection molding and/or thermoform production techniques.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following Figs., wherein like reference numerals refer to like parts throughout the several views, and wherein.

DETAILED DESCRIPTION OF EXEMPLARY EMBODIMENTS

Figure 1A:
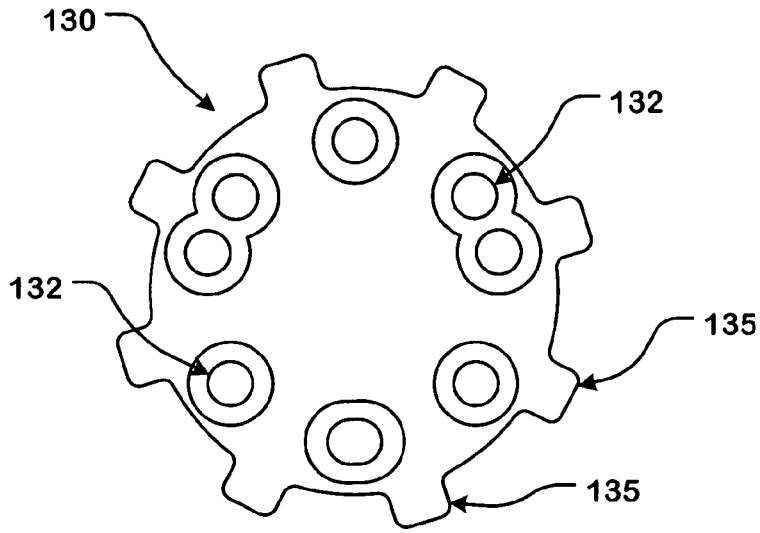
FIG. 1A shows a front view of a first embodiment of an accessory mounting plate of the accessory attachment system of the present invention.
Figure 1B:
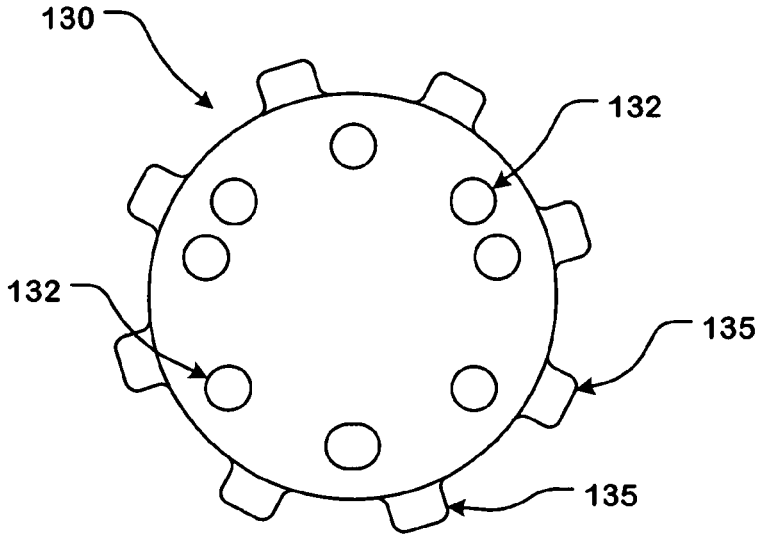
FIG. 1B shows a rear view of a first embodiment of an accessory mounting plate of the accessory attachment system of the present invention.
Figure 2A:
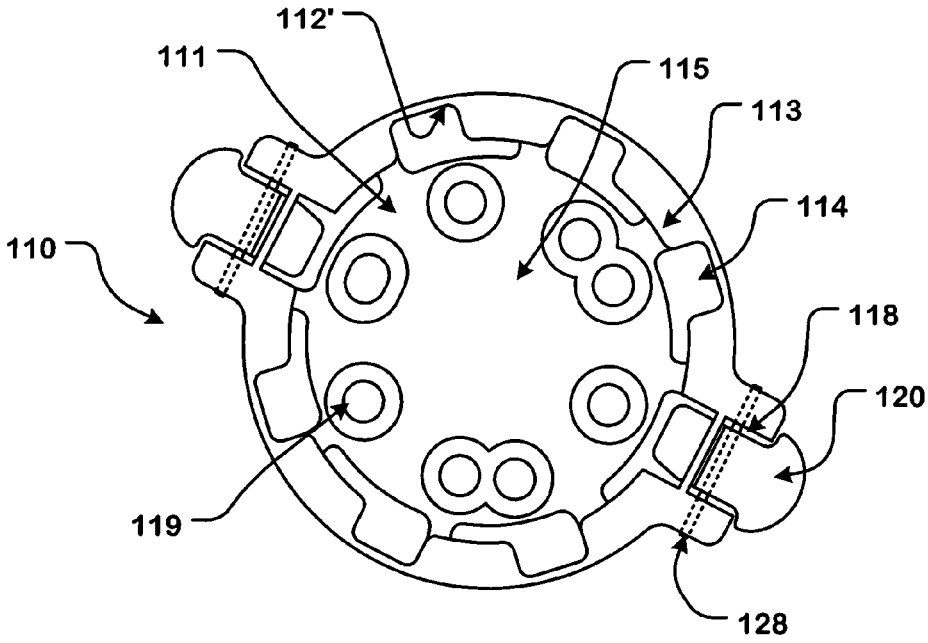
FIG. 2A shows a front view of a first embodiment of a platform body of the accessory attachment system of the present invention.
Figure 2B:
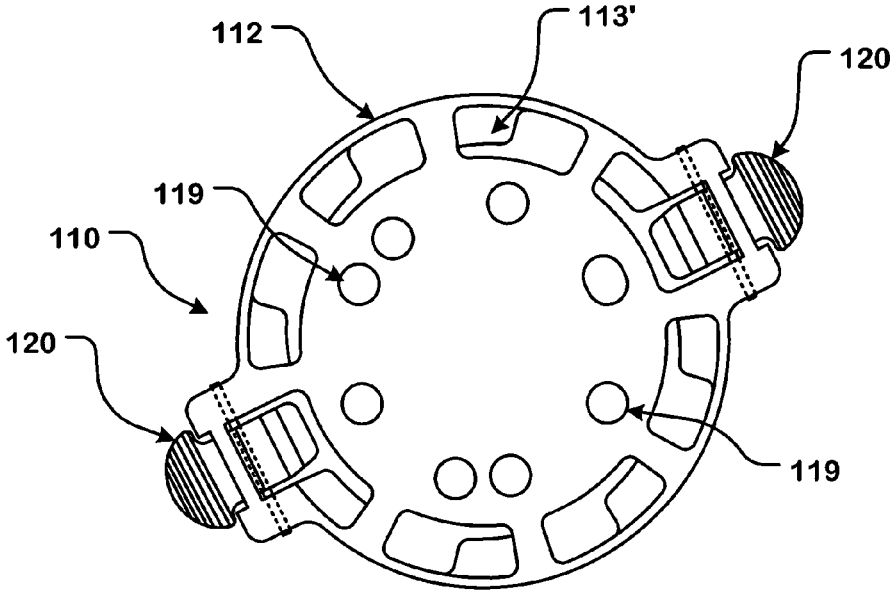
FIG. 2B shows a rear view of a first embodiment of a platform body of the accessory attachment system of the present invention.

For simplicity and clarification, the design factors and operating principles of the accessory attachment system according to this invention are explained with reference to various exemplary embodiments of an accessory attachment system according to this invention. The basic explanation of the design factors and operating principles of the accessory attachment system is applicable for the understanding, design, and operation of the accessory attachment system of this invention.

It should also be appreciated that while the embodiments of this invention are described with reference to a handgun holster being attached to the accessory attachment system, any handgun holster, other holster, accessory carrier, or other carrier, platform, carrier rail (i.e., a Picatinny rail) or device may be removably or permanently attached or coupled to the accessory attachment system of this invention. Thus, it should be understood that the accessory attachment system of this invention may be utilized in conjunction with any carrier or holder for any handgun, edged handgun, ammunition magazine, less than lethal product (i.e., a taser, pepper spray, mace canister, baton, or the like), radio, flashlight, cellular telephone, personal digital assistants, or other device.

It should also be appreciated that the terms "carrier", "holder", "holster", "plate", and "platform" are used for basic explanation and understanding of the operation of the systems, methods, and apparatuses of this invention. Therefore, the terms "carrier", "holder", "holster", "plate", and/or "platform" are not to be construed as limiting the systems, methods, apparatuses, or applications of this invention.

Referring now to the drawing figures, FIGS. 1-9 show various views of the individual and assembled components of a first exemplary embodiment of an accessory attachment system according to this invention. As shown in FIGS. 1-9, the accessory attachment system 100 includes at least some of a platform body 110 and an accessory mounting plate 130.

The accessory mounting plate 130 has a substantially circular, disk shape having a top surface 131 and a bottom surface 131'. A plurality of mounting plate projections 135 extend substantially radially from a perimeter of the accessory mounting plate 130, each mounting plate projection 135 having a projection top surface 135'.

The accessory mounting plate 130 includes a plurality of mounting plate apertures 132 formed therethrough. The size and positional relationship of the mounting plate apertures 132 is such that the mounting plate apertures 132 are each capable of being aligned with and interacting with corresponding holster body attachment points 182 on the holster 180 and an appropriate attachment means 170 to allow the accessory mounting plate 130, and the holster 180 to be coupled together.

Each of the mounting plate apertures 132 is formed so as to be capable of receiving an attachment means 170, which passes therethrough for securing the holster 180, via the holster body attachment points 182, to the accessory mounting plate 130. Thus, the mounting plate apertures 132, in cooperation with appropriate attachment means 170 and holster body attachment points 182, allow a holster 180 (or any other accessory carriers or mounting devices) to be attached to the accessory attachment system 100.

In various exemplary embodiments, the attachment means 170 may comprise screws, snap-together parts, or any other known or later developed means for removably attaching or coupling the accessory mounting plate 130 to cooperating attachment points of the holster 180.

In various exemplary embodiments, the shape and positional relationship of the mounting plate apertures 132 and the holster body attachment points 182 may be such that simultaneous interaction of only one mounting plate aperture 132, and holster body attachment point 182 is necessary to attach the accessory mounting plate 130 to the holster 180.

In various exemplary embodiments, the mounting plate apertures 132 may be countersunk in order to allow the attachment means 170 to be at or below a surface of the accessory mounting plate 130.

The platform body 110 comprises a substantially circular bottom wall 111 having a bottom wall top surface 111' and a bottom wall bottom surface 111". A perimeter wall 112 having an inner perimeter wall surface 112' extends from the bottom wall top surface 111' of the bottom wall 111 to a locking ledge 113 that extends inwardly from the perimeter wall 112 resulting in an internal projection that extends toward a center of the platform body 110. A lower surface of the locking ledge 113 defines a locking surface 113'.

Thus, the bottom wall top surface 111', the perimeter wall surface 112', and the locking surface 113' define a platform recess 115.

The platform body 110 includes a plurality of mounting plate apertures 132 formed therethrough. Each of the platform body apertures 119 is formed so as to be capable of receiving an appropriate attachment means, which passes therethrough for securing the platform body 110 to a device, carrier, or surface.

In various exemplary embodiments, the platform body 110 can be mounted directly to a surface (i.e., a piece of furniture, a side of a counter or desktop, a vehicle console, shipboard bulkhead, etc.) as opposed to being worn by a user. In these exemplary embodiments, an attachment means may be used to attach or couple the platform body 110 directly to the surface. Alternatively, one or more spacers may be included between the platform body 110 and the mounting surface so as to provide sufficient space between the platform body 110 and mounting surface to allow proper function and operation of the platform body release levers 120 and/or to allow the user to rotate the attached holster or accessory carrier.

It should also be appreciated that the platform body 110 may be capable of being attached or coupled to clothing or a portion of webbing or strap material, such as, for example, the strap material used to form a shoulder holster. The platform body 110 may also be attached or coupled to a surface or item using, for example, one or a plurality of metallic and/or polymer fasteners of any kind (including but not limited to screws, bolts, nails or rivets) employed in any pattern, adhesives, glues, solders, and other binding agents as well as welding, threading, sewing, the use of male and female snaps, hook and loop fasteners or any other type of fastening agent, device, or combining means.

It should be further recognized that in addition to "fastening" the device to another surface, it is within the scope of this invention that the features of the device could also be integrated directly into (or applied to) that surface itself (one-piece) or the device and the surface could be designed and/or shaped so that they could be coupled together without the need for separate fasteners or the use of other fastening or combining means (two-pieces).

Furthermore, it should also be recognized that while the bottom wall bottom surface 111" is illustrated as being substantially plainer, a bottom wall bottom surface 111" can be of any shape or contour as needed.

The locking ledge 113 includes a plurality of slots 114 extending toward the perimeter wall 112. The outer circumference of the accessory mounting plate 130 and the mounting plate projections 135 are formed such that a number of mounting plate projections 135 is equal to the number of slots 114. Furthermore, the mounting plate projections 135 and the slots 114 are formed so as to correspond to each other such that when the mounting plate projections 135 are aligned with the slots 114, the accessory mounting plate 130 can pass the locking ledge 113 into the platform recess 115 of the platform body 110.

It should be appreciated that the number, size, and placement of the mounting plate projections 135 and the slots 114 is a design choice based upon the desired functionality of the accessory attachment system 100.

The platform body 110 also includes one or more release levers 120, each of which is positioned within a release lever receiving slot 118 and held in position by a pivot pin 128.

The platform body release levers 120 comprise at least some of a thumb/finger engagement portion 124 and an accessory plate engagement portion 122. The thumb/finger engagement portion 124 and the accessory plate engagement portion 122 are generally separated by a fulcrum or release lever pivot pin 128.

In various exemplary embodiments, the thumb/finger engagement portion 124 is smooth and non-textured. Alternatively, at least one surface of the thumb/finger engagement portion 124 may include a textured or serrated portion (as illustrated) so that the thumb/finger engagement portion 124 may be distinguished tactilely from other portions of the release lever 120 or the accessory attachment system 100 and to aid the user's thumb/finger as the user's thumb/finger applies a pivoting force to the release lever 120 and pivots the release lever 120 to a release position.

In various exemplary, non-limiting embodiments, release lever 120 is pivotally connected within the lever receiving slot 118, via a fulcrum or pivot pin 128.

Figure 4A:
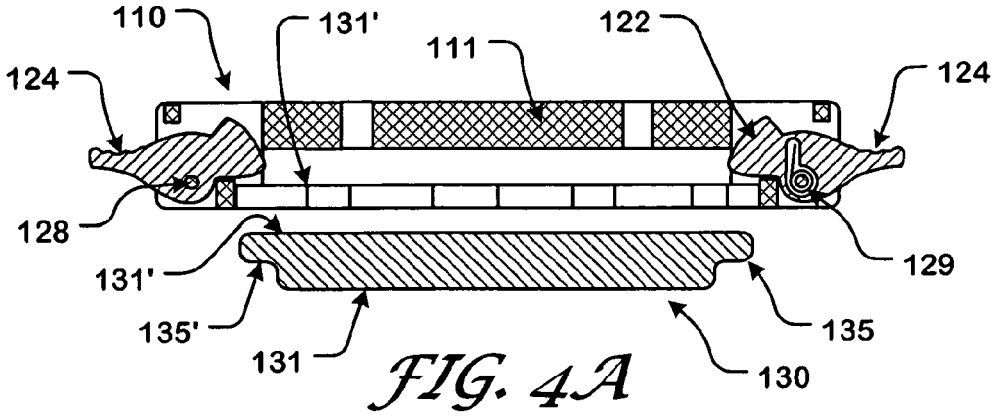
FIG. 4A shows a cross-sectional view of a first embodiment of an accessory mounting plate prior to being positioned within a platform body to form the accessory attachment system of the present invention.
Figure 4B:
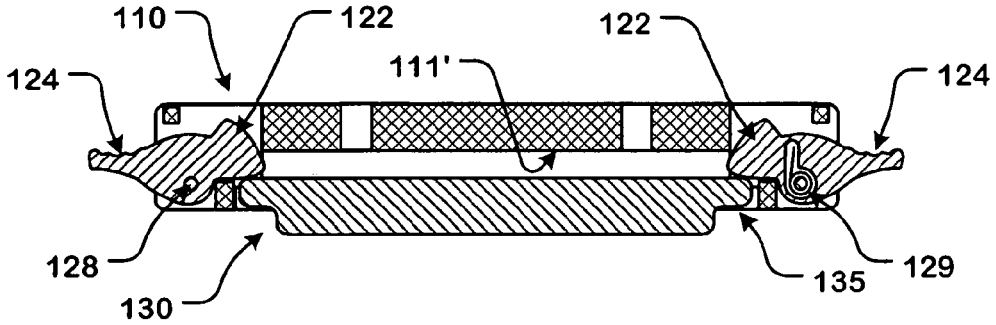
FIG. 4B shows a cross-sectional view of a first embodiment of an accessory mounting plate being initially positioned within a platform body to form the accessory attachment system of the present invention.

The release lever 120 is pivotable between a locking position and an unlocking position. When the release lever 120 is in the locking position, at least a portion of the accessory plate engagement portion 122 extends into a portion of the platform recess 115, as illustrated in FIGS. 4A, 4B, and 4D.

In various exemplary embodiments, the accessory plate engagement portion 122 may include a ramped or tapered surface on one or both sides of the accessory plate engagement portion 122.

In various exemplary embodiments, the release lever 120 is biased to the locking position by, for example, a spring means or biasing means 129. In various exemplary embodiments, the spring means or biasing means 129 comprises a portion of spring steel or a spring-biased coil. Alternatively, the spring means or biasing means 129 may comprise an extension or finger that extends from either the release lever 120 or a portion of the platform body 110 that provides a biasing force to the release lever 120 relative to the platform body 110.

Figure 4C:
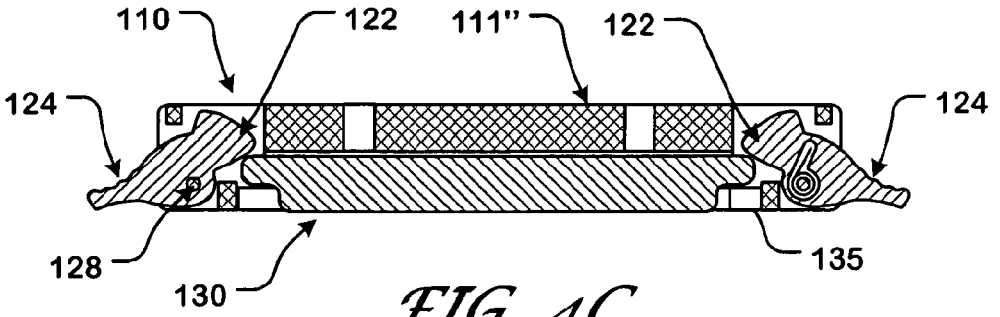
FIG. 4C shows a cross-sectional view of a first embodiment of an accessory mounting plate being initially rotated to engaged position within a platform body to form the accessory attachment system of the present invention.
Figure 4D:
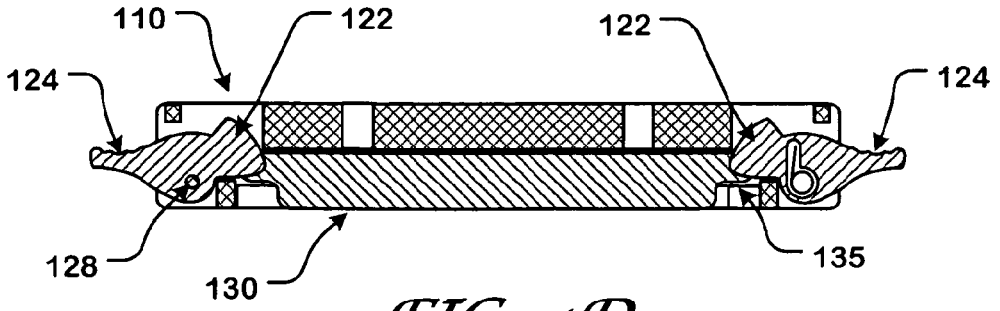
FIG. 4D shows a cross-sectional view of a first embodiment of an accessory mounting plate in an engaged position within a platform body to form the accessory attachment system of the present invention.

When the bias of the release lever 120 is overcome and the release lever 120 is pivoted from the locking position to the unlocking position, the accessory plate engagement portion 122 is at least partially withdrawn from the platform recess 115, as illustrated in FIG. 4C. When the pivoting force is removed from the release lever 120, the release lever 120 returns to the biased locking position.

Figure 3A:
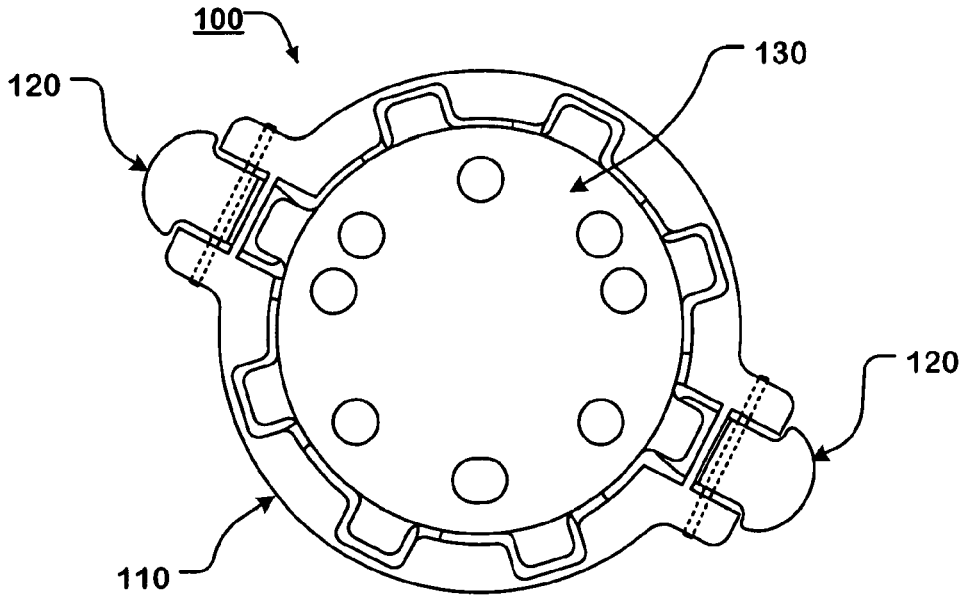
FIG. 3A shows a front view of a first embodiment of an accessory mounting plate being initially positioned within a platform body to form the accessory attachment system of the present invention.

When, as illustrated in FIGS. 3A-4D, the accessory mounting plate 130 and the platform body 110 are assembled together, the mounting plate protrusions 135 are initially aligned within the slots 114 and the accessory mounting plate 130 is seated atop the platform recess 115. As illustrated in FIGS. 3A and 4B, when the accessory mounting plate 130 is seated atop the platform recess 115, at least a portion of the mounting plate protrusions 135 contact the accessory plate engagement portion 122 of the release levers 120.

Figure 3B:
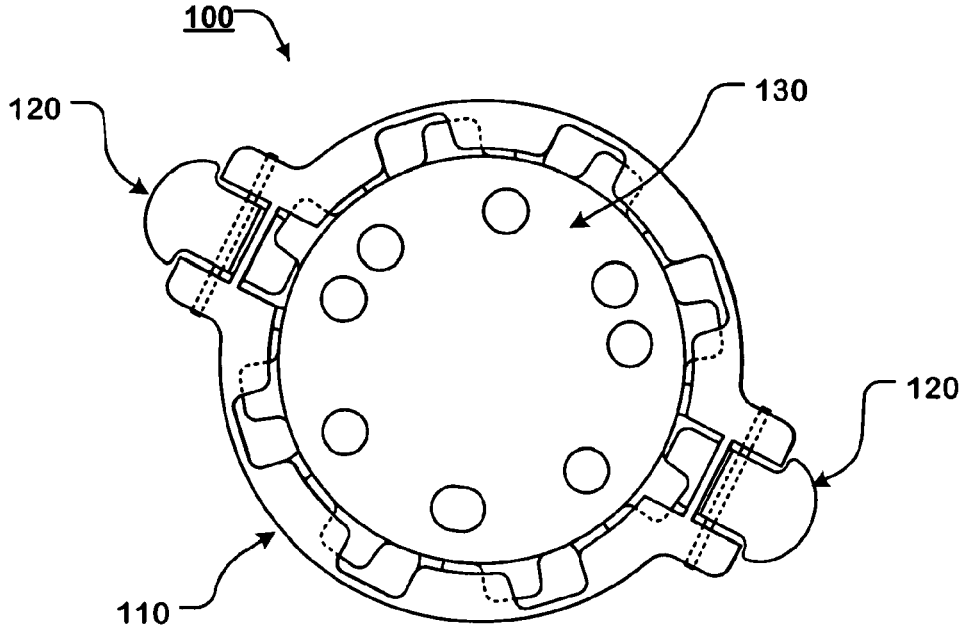
FIG. 3B shows a front view of a first embodiment of an accessory mounting plate being initially rotated to engaged position within a platform body to form the accessory attachment system of the present invention.

When, as illustrated in FIG. 4C, additional force is applied to seat the accessory mounting plate 130 within the platform recess 115, the spring bias of the release levers 120 is overcome and the release levers 120 pivot, via release lever pivot pins 128, allowing the mounting plate bottom surface 131' to come into contact with the bottom wall top surface 111'. When the mounting plate bottom surface 131' has come into contact with the bottom wall top surface 111', the mounting plate projections 135 are sufficiently within the platform recess 115 so as to rotate below the locking surface 113' of the locking ledge 113, as illustrated in FIG. 3B.

Figure 3C:
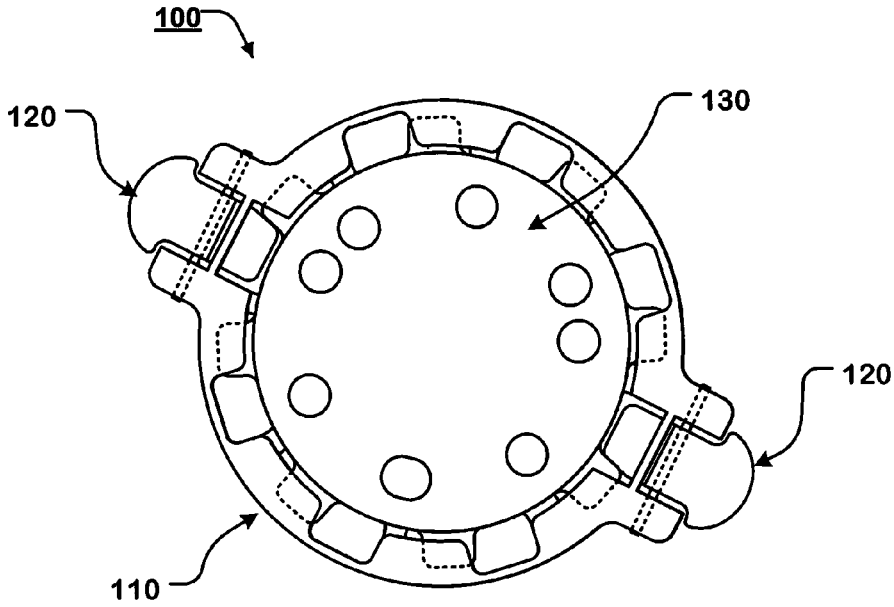
FIG. 3C shows a front view of a first embodiment of an accessory mounting plate in an engaged position within a platform body to form the accessory attachment system of the present invention.
Figure 3D:
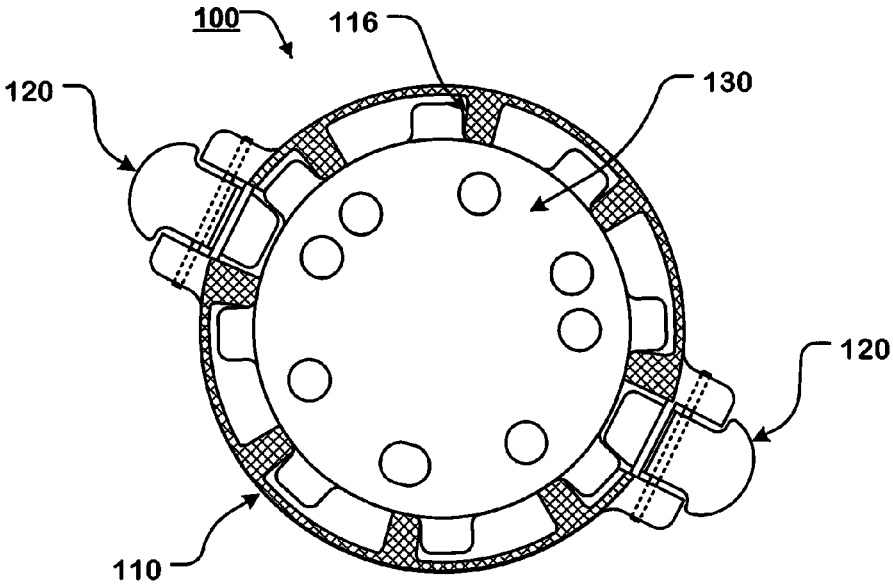
FIG. 3D shows a more detailed view of the accessory mounting plate in the engaged position within a platform body to form the accessory attachment system of the present invention.

When the accessory mounting plate 130 has been rotated such that the mounting plate projections 135 contact or nearly contact the internal stops 116 formed within the platform recess 115 of the platform body 110, as illustrated in FIG. 3D, the accessory plate engagement portion 122 of the release lever 120 is in a position between mounting plate projections 135 and, as illustrated in FIGS. 3C and 4D, the bias of the release lever 120 pivots the release lever 120 to the locking position. With the release lever 120 return to the locking position, rotation of the accessory mounting plate 130 is limited or eliminated by the interaction of the mounting plate projections 135 and the internal stops 116 and the accessory plate engagement portion 122 of the release lever 120.

The interaction of the mounting plate projections 135 and the internal stops 116 and the release lever 120 only allows the accessory mounting plate 130 to rotate a predetermined number of degrees, as dictated predominantly by the amount of space between the mounting plate projections 135, the internal stops 116, and the accessory plate engagement portion 122 of the release lever 120.

When the accessory mounting plate 130 is locked within the platform body 110, the perimeter wall surface 112' interacts with the mounting plate projections 135 to limit movement of the accessory mounting plate 130 in a direction parallel to the longitudinal axis of the platform body 110 and interaction between the locking ledge surface 113' and the top surface 135' of the mounting plate projections 135 restricts movement of the accessory mounting plate 130 in a direction perpendicular to the longitudinal axis of the platform body 110.

Thus, when locked within the platform recess 115 of the platform body 110, the accessory mounting plate 130 is restrained from being further rotated within the platform recess 115 or pulled through the platform recess 115 by the interaction of the mounting plate bottom surface 131' and the mounting plate projections top surface 135' with the bottom wall top surface 111', the perimeter wall surface 112', and the locking ledge surface 113'.

If a user desires to remove the accessory mounting plate 130 from the platform body 110, the user contacts the thumb/finger engagement portion 124 of the release lever 120, overcomes any bias of the release lever 120, and pivots the release lever 120 from the locking position to the unlocking position.

When the release lever 120 is pivoted from the locking position to the unlocking position, the accessory plate engagement portion 122 of the release lever 120 is withdrawn a sufficient distance from the platform recess 115 so as to allow the accessory mounting plate 130 to be rotated such that the mounting plate projections 135 are aligned with the slots 114, as illustrated in FIG. 3A.

Once the accessory mounting plate 130 has been removed from the platform body 110, the accessory mounting plate 130 can optionally be rotationally repositioned and three secured within the platform body 110, as described herein.

Figure 5:
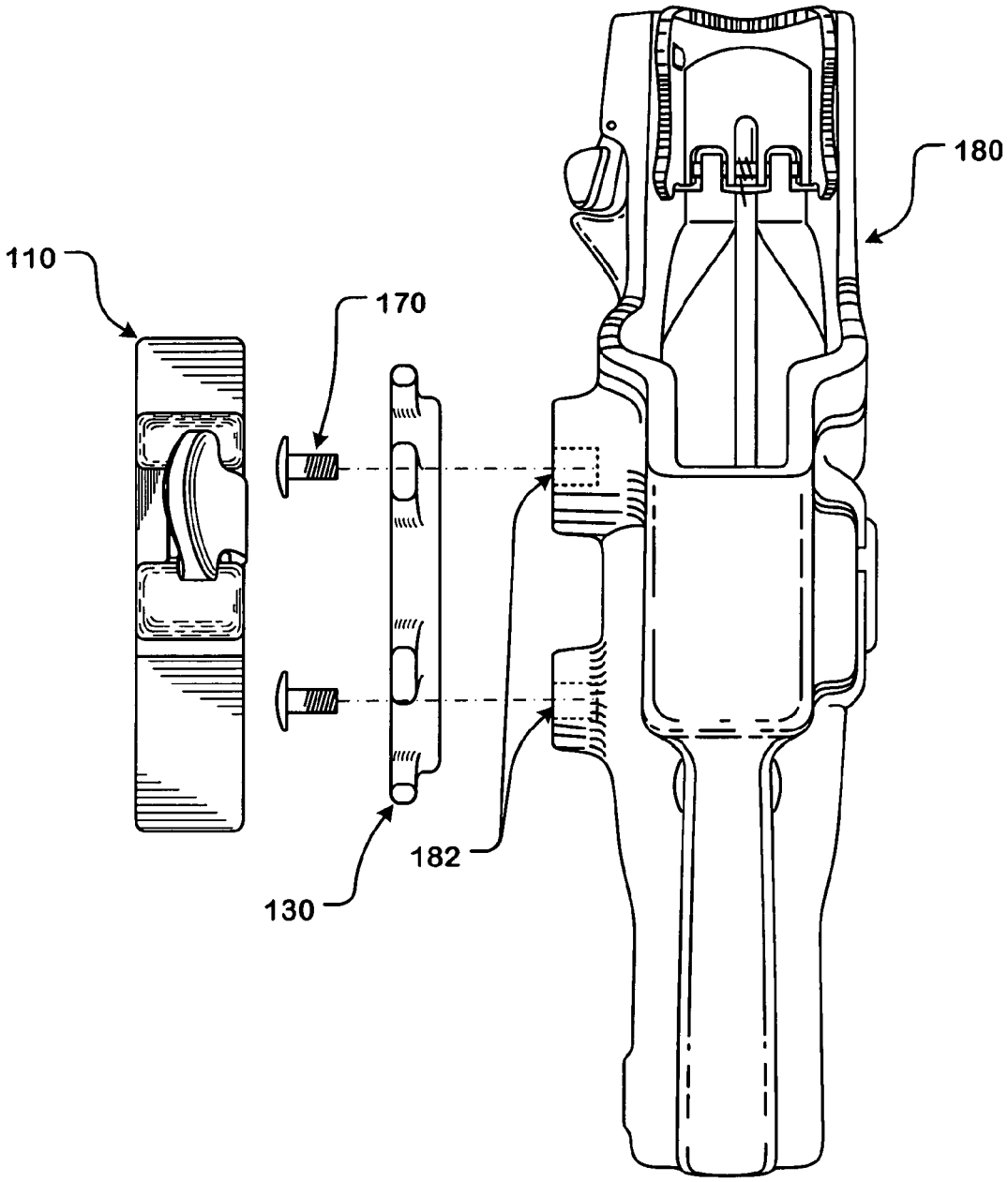
FIG. 5 shows an exploded view of a first embodiment of an accessory mounting plate and a platform body being used in conjunction with an exemplary holster in accordance with the present invention.
Figure 6:
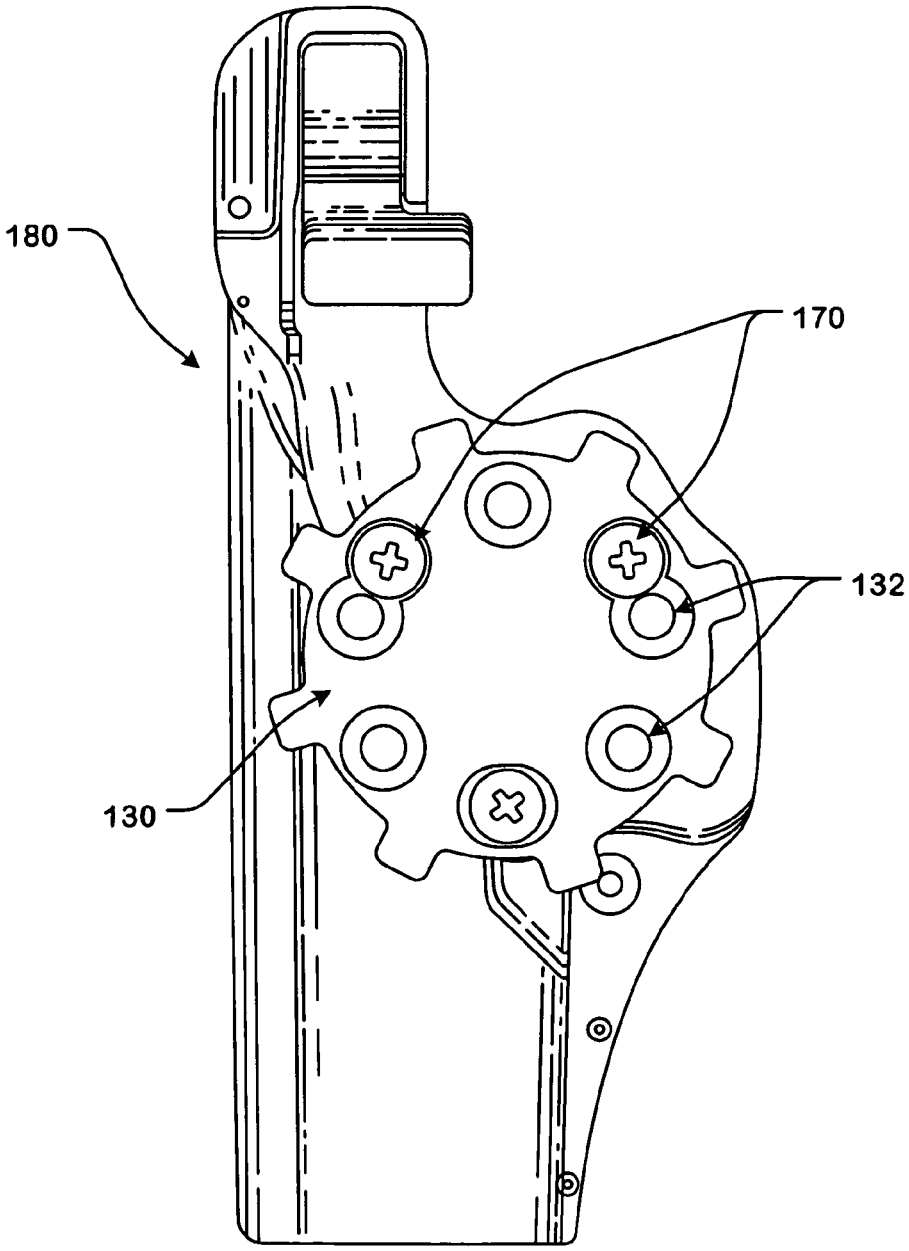
FIG. 6 shows a front view of a first embodiment of an accessory mounting plate coupled to an exemplary holster in accordance with the present invention.

As illustrated in FIGS. 5 and 6, when the accessory mounting plate 130 is to be attached, for example, to a holster 180, appropriate mounting plate apertures 132 are aligned with holster body attachment points 182 and the mounting plate top surface 131 of the accessory mounting plate 130 is abutted to the holster 180. Once the accessory mounting plate 130, and in the holster 180 are appropriately aligned and abutted together, attachment means 170 are used to secure the accessory mounting plate 132 the holster 180.

Figure 7:
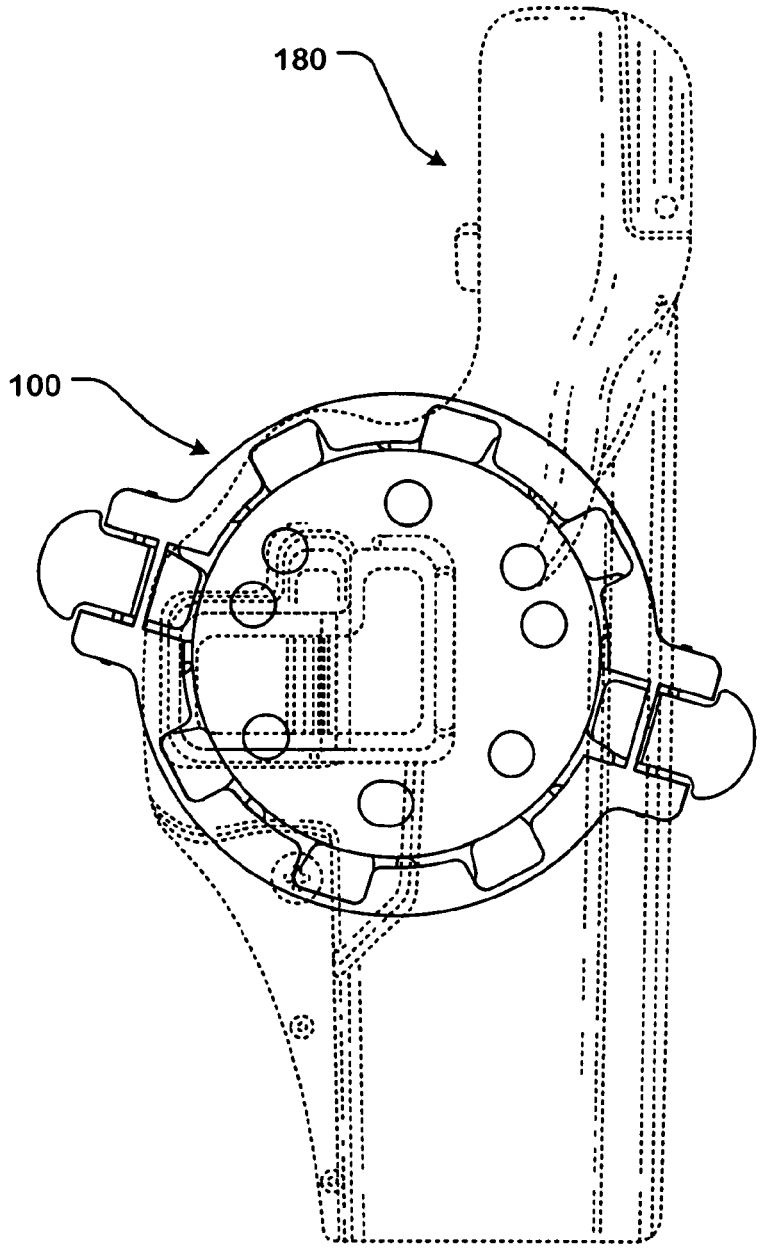
FIG. 7 shows the accessory attachment system of the present invention utilized in conjunction with an exemplary holster, wherein the holster is engaged in a substantially upright position.
Figure 8:
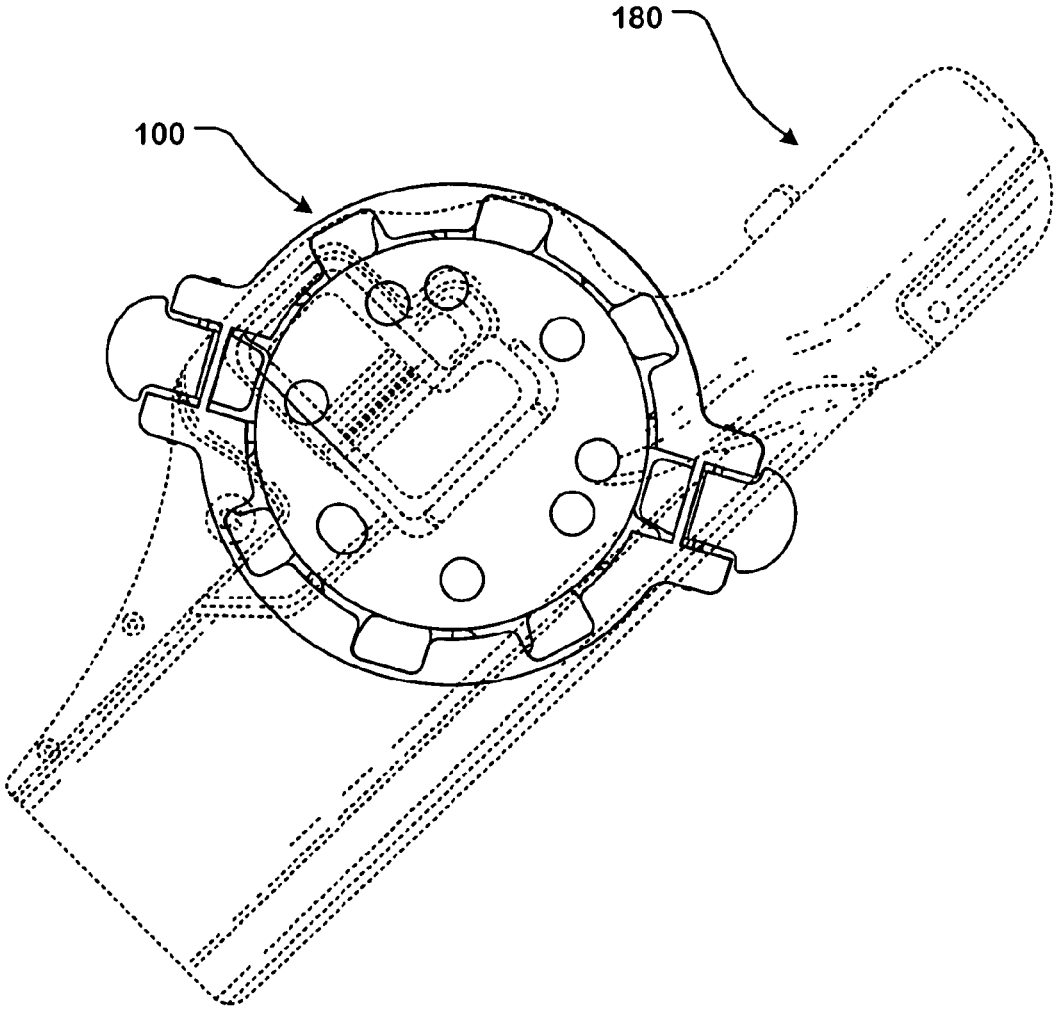
FIG. 8 shows the accessory attachment system of the present invention utilized in conjunction with an exemplary holster, wherein the holster is engaged in a substantially forward position.
Figure 9:
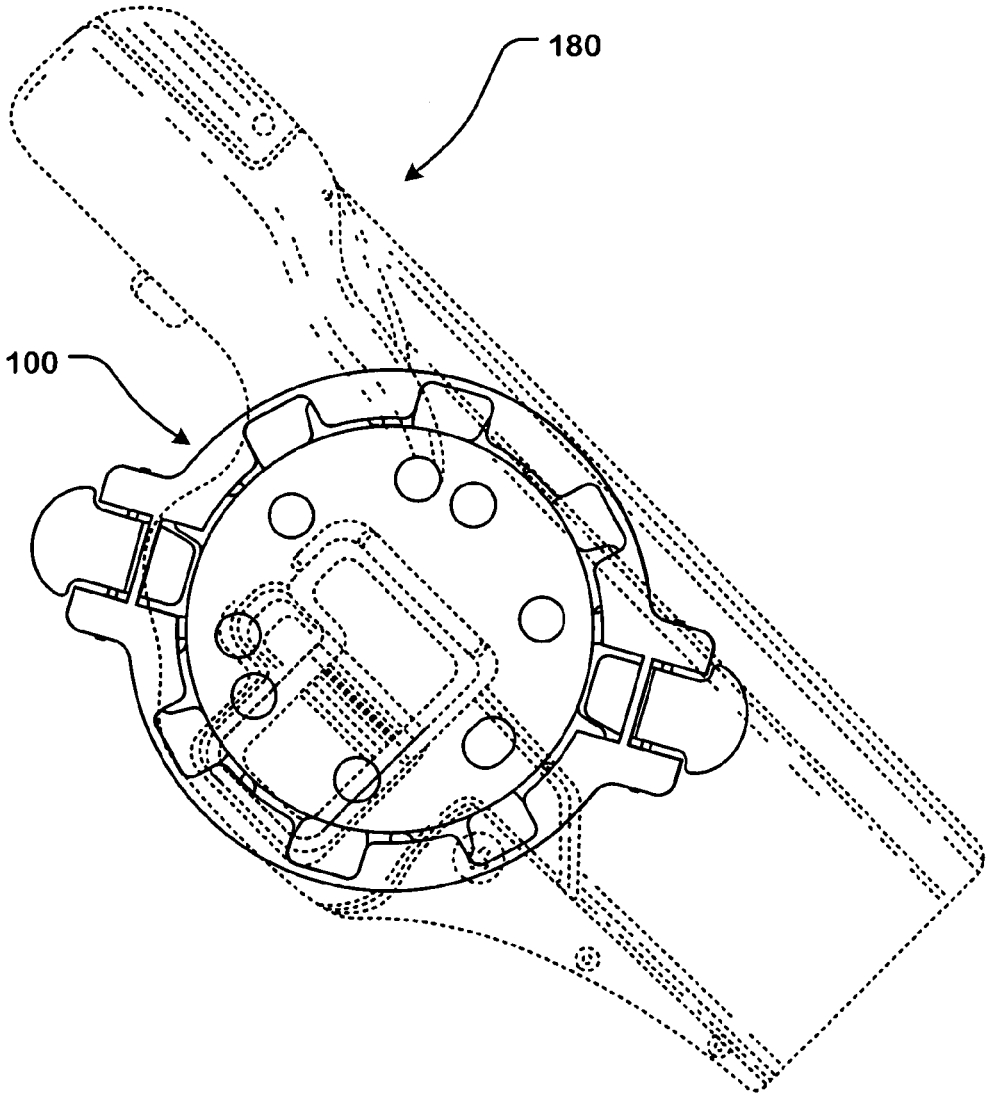
FIG. 9 shows the accessory attachment system of the present invention utilized in conjunction with an exemplary holster, wherein the holster is engaged in a substantially rearward position.

When the accessory mounting plate 130 has been attached to, for example, the holster 180, the holster 180 can be removably attached, via the accessory mounting plate 130, to the platform body 110. As illustrated in FIGS. 7-9, the holster 180 can be secured at a number of rotational angles, relative to the platform body 110. Thus, when the platform body 110 is attached or coupled to a carrier or device, the holster 180 can optionally be attached in, for example, a substantially upright position, a substantially forward position, or a substantially rearward position.

As illustrated herein, the accessory attachment system 100 is used in conjunction with an exemplary holster 180. It should be appreciated that the holster 180 may be any type of holster. Additionally, while a holster 180 is illustrated, it should be understood that the accessory attachment system 100 of this invention may be utilized in conjunction with any pouch, carrier, or holder for any handgun, edged handgun, ammunition magazine, less than lethal product (i.e., a taser, pepper spray, mace canister, baton, or the like), radio, flashlight, cellular telephone, personal digital assistants, or other device.

Figure 10:
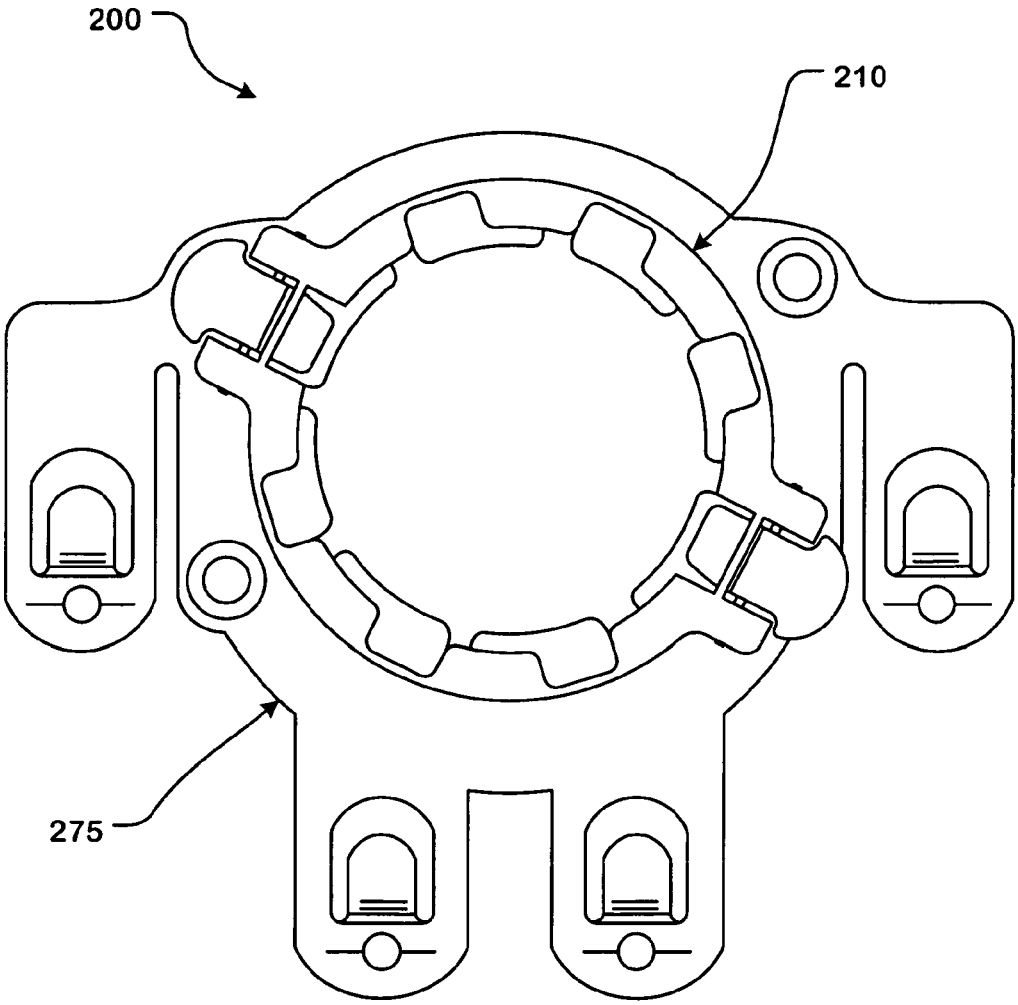
FIG. 10 shows a second exemplary embodiment of an accessory attachment system of the present invention, wherein the platform body is formed as an integral component of a MOLLE or STRIKE attachment device.

FIG. 10 shows a second exemplary embodiment of an accessory attachment system according to this invention. In the accessory attachment system 200, the platform body 210 corresponds to and operates similarly to the platform body 110, as described above with respect to FIGS. 1-9. However, the platform body 210 is formed as an integral component of a universal mounting platform 275 that is capable of being removably attached or coupled to a portion of MOLLE or S.T.R.I.K.E. webbing. In various exemplary embodiments, the universal mounting platform is as described in U.S. patent application Ser. No. 11/906,629, filed Oct. 3, 2007, entitled Universal Mounting Platform, the disclosure of which is incorporated herein by reference.

While this invention has been described in conjunction with the exemplary embodiments outlined above, it is evident that many alternatives, modifications, and variations will be apparent to those skilled in the art. For example, while the accessory mounting plate has been described as being a separate component that is attachable to a holster or other carrier or device, it should be appreciated that the accessory mounting plate may be permanently attached to the holster or other carrier or device or integrally formed as a portion of the holster or other carrier or device.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. An accessory attachment system, comprising:

a platform body having a platform recess, wherein the platform recess is at least partially defined by a bottom wall, a perimeter wall that extends substantially perpendicular to the bottom wall, and a locking ledge that extends inwardly from the perimeter wall substantially parallel to the bottom wall, and wherein the locking ledge includes a plurality of slots extending toward the perimeter wall;

an accessory mounting plate having a plurality of mounting plate projections extending substantially radially therefrom and a plurality of mounting plate apertures formed therethrough;

wherein at least some of the mounting plate projections correspond to at least some of the slots such that when the mounting plate projections are aligned with the corresponding slots, the accessory mounting plate can pass the locking ledge into the platform recess of the platform body;

an axis defined along a side wall of the perimeter wall, wherein the axis extends from the bottom wall to the locking ledge;

at least one release lever, pivotably coupled, via a pivot pin, to the platform body, wherein the pivot pin is positioned between a thumb/finger engagement portion of the at least one release lever and an accessory plate engagement portion of the at least one release lever, wherein a longitudinal axis of the pivot pin is substantially perpendicular to the axis, wherein the release lever is pivotable between a locking position and an unlocking position, and wherein when the release lever is in the locking position, at least a portion of the accessory plate engagement portion of the release lever extends into a portion of the platform recess; and a plurality of internal stops formed within the platform recess for interacting with the mounting plate projections to limit rotation of the accessory mounting plate within the platform recess;

wherein the accessory mounting plate can be secured within a portion of the platform recess such that the mounting plate projections are secured between the internal stops and the accessory plate engagement portion when the release lever is in the locking position.

2. The accessory attachment system of claim 1, wherein the accessory mounting plate has a substantially circular, disk shape.

3. The accessory attachment system of claim 1, wherein the size and positional relationship of the mounting plate apertures are such that at least some of the mounting plate apertures can be aligned with corresponding attachment points of an accessory.

4. The accessory attachment system of claim 3, wherein the accessory mounting plate can be coupled, via accessory attachment means passing through at least some of the mounting plate apertures, to the accessory.

5. The accessory attachment system of claim 3, wherein the accessory is a holster, a pouch, a carrier, or a holder.

6. The accessory attachment system of claim 1, wherein the bottom wall is substantially circular.

7. The accessory attachment system of claim 1, wherein at least some of the mounting plate apertures are formed so as to be capable of interacting with an attachment means, which passes therethrough for securing the platform body to a device, carrier, or surface.

8. The accessory attachment system of claim 1, wherein the thumb/finger engagement portion is separated from the accessory plate engagement portion proximate the pivot pin.

9. The accessory attachment system of claim 1, wherein when the release lever is in the locking position, at least a portion of the accessory plate engagement portion of the release lever extends into a portion of the platform recess.

10. The accessory attachment system of claim 1, wherein when the release lever is pivoted from the locking position to the unlocking position, the accessory plate engagement portion is at least partially withdrawn from the platform recess.

11. The accessory attachment system of claim 1, wherein the release lever is biased to the locking position.

12. The accessory attachment system of claim 11, wherein the release lever is biased to the locking position by a spring means or biasing means.

13. The accessory attachment system of claim 1, wherein the accessory mounting plate can be removed from the platform recess when the release lever is in the unlocking position.

14. The accessory attachment system of claim 1, wherein the platform body is formed as an integral component of a universal mounting platform.

15. An accessory attachment system, comprising:

a platform body having a platform recess, wherein the platform recess is at least partially defined by a bottom wall, a perimeter wall that extends substantially perpendicular to the bottom wall, and a locking ledge that extends inwardly from the perimeter wall substantially parallel to the bottom wall, and wherein the locking ledge includes a plurality of slots extending toward the perimeter wall;

an accessory mounting plate having a plurality of mounting plate projections extending substantially radially therefrom and a plurality of mounting plate apertures formed therethrough;

wherein the mounting plate projections correspond to the slots such that when the mounting plate projections are aligned with the corresponding slots, the accessory mounting plate can pass the locking ledge into the platform recess of the platform body;

an axis defined along a side wall of the perimeter wall, wherein the axis extends from the bottom wall to the locking ledge;

at least two release levers, wherein each release lever is pivotably coupled, via a pivot pin, to the platform body, wherein the pivot pin is positioned between a thumb/finger engagement portion of the release lever and an accessory plate engagement portion of the release lever, wherein a longitudinal axis of each pivot pin is substantially perpendicular to the axis, wherein the release levers are pivotable between a locking position and an unlocking position, and wherein when the release levers are in the locking position, at least a portion of the accessory plate engagement portion of each release lever extends into a portion of the platform recess; and a plurality of internal stops formed within the platform recess for interacting with the mounting plate projections to limit rotation of the accessory mounting plate within the platform recess;

wherein the accessory mounting plate can be secured within a portion of the platform recess such that the mounting plate projections are secured between the internal stops and the accessory plate engagement portion when the release lever is in the locking position.

* * * * *